US005491866A

United States Patent [19]

Simonds

[11] Patent Number: 5,491,866

[45] Date of Patent: Feb. 20, 1996

[54] TOOTHBRUSH

[76] Inventor: James A. Simonds, 3335 Scrub Oak Dr., Santa Rosa, Calif. 95404

[21] Appl. No.: 147,756

[22] Filed: Nov. 5, 1993

[51] Int. Cl.[6] ..... A46B 9/04

[52] U.S. Cl. ..... 15/167.1; 15/172

[58] Field of Search ..... 15/172, 201, 167.1, 15/167.2, 185, 143.1, 144.1, 176.1, 174.4, 174.5, 174.6; 403/76, 122, 129

[56] References Cited

U.S. PATENT DOCUMENTS

| | | | |
|---|---|---|---|
| 1,706,555 | 3/1929 | Weis | 15/172 |
| 1,968,303 | 7/1934 | McMath | 15/172 |
| 2,122,619 | 7/1938 | McMath | 15/167.1 |
| 2,274,042 | 2/1942 | Cosby | 15/167.1 |
| 3,000,029 | 9/1961 | Wood | 15/172 |
| 3,065,480 | 11/1962 | Sexton | 15/172 |
| 3,398,421 | 8/1968 | Rashbaum | 15/172 |
| 3,474,481 | 10/1969 | Soleymani et al. | 15/167.1 |
| 4,020,521 | 5/1977 | Velasquez | 15/172 |
| 4,115,894 | 9/1978 | Peterson | 15/167.1 |
| 4,170,803 | 10/1979 | Saito | 15/144.1 |
| 4,330,896 | 5/1982 | Booth | 15/172 |
| 4,403,623 | 9/1983 | Mark | 15/172 |
| 4,488,328 | 12/1984 | Hyman | 15/167.1 |
| 4,575,894 | 3/1986 | Stevens et al. | 15/172 |
| 4,654,922 | 4/1987 | Chen | 15/172 |
| 4,667,360 | 5/1987 | Marthaler et al. | 15/167.1 |
| 4,704,758 | 11/1987 | Hoffman | 15/143.1 |
| 5,228,166 | 7/1993 | Gomez | 15/172 |

FOREIGN PATENT DOCUMENTS

| | | | |
|---|---|---|---|
| 1070224 | 2/1954 | France | 15/172 |
| 2583963 | 1/1987 | France . | |
| 2349245 | 4/1975 | Germany . | |
| 2427877 | 12/1975 | Germany . | |
| 17808 | 8/1916 | United Kingdom | 15/172 |
| 109877 | 10/1917 | United Kingdom | 15/144.1 |
| 687164 | 2/1953 | United Kingdom | 15/172 |
| WO95/01113 | 1/1995 | WIPO . | |

*Primary Examiner*—David Scherbel
*Assistant Examiner*—Tony G. Soohoo
*Attorney, Agent, or Firm*—Corwin R. Horton

[57] ABSTRACT

An articulate toothbrush having a handle with an elongate grip and a support section extending from the grip to the brush head with an arch shape that diverges fron the longitudinal axis of the grip to an apex at a point of maximum divergence. The arch has a leg that returns toward the longitudinal axis of the grip to the axis of a pivot connection with a brush head which is a substantial distance toward the longitudinal axis of the grip from the apex of the arch. The brush head has a longitudinal axis and terminates along that axis in a heel in the direction of the grip of handle and in a toe in the direction away from the grip. The top of the brush head is proximal to the distal leg of the support and the bottom of the brush head, which is distal to the distal leg, has bristles depending therefrom. The distal leg of the support is connected to the top of the brush head at a recess therein at a position along the longitudinal axis in the direction toward the toe from the midpoint between the heel and the toe that is closer to the midline than to the toe of the brush head by a pivot that has an axis of rotation generally normal to longitudinal axis of the grasp and to the longitudinal axis of the brush head for relative pivotal movement between the brush head and the handle over a desired acute angle arc. A slot extends along the top of the brush head from the recess toward the heel for receiving the distal leg upon relative rotation of the heel in the direction of the distal leg.

2 Claims, 2 Drawing Sheets

TOOTHBRUSH

BACKGROUND OF THE INVENTION

1. Field of the Invention

This invention relates generally to dental hygiene techniques and apparatus, and more specifically to an improved toothbrush mechanism to efficiently accommodate cleaning sites in the mouth.

2. Description of the Prior Art

Toothbrushes have been designed to clean teeth by removing plaque and food debris with brush bristles of various dimensions, firmness, materials, and retention methods. Originally, and dating back several centuries, the toothbrush had a design of brush bristles mounted on a handle which carried the bristles into the mouth. The fixed nature of the brush handle required that the user manipulate the brush into exact position before activating the brushing motion. Variations of brush design from uneven bristle heights to "serrated" designed bristle patterns attempted to enable bristles to extend between the teeth for greater cleansibility. However, the brush handle and head were always rigidly fixed in one position.

Some toothbrush designs have provided rotational brush heads rotating on an axis parallel to the axis described by the brush head bristles and perpendicular to the targeted tooth surfaces. However, they have no rotation to accommodate the curvature of the dental arch.

Other toothbrush designs attempted to create better hygiene access through changing the angulation between the brush head and the brush handle. These designs had a number of proposed angulations between the head and handle, but the head and handle were fixed in place relative to each other regardless of the angulation.

The design of toothbrushes with an angled head had either single or double (bi-angled) bends in the connector. The head was angled toward the targeted teeth. The intention of the bend was to allow the brush to function around the corners of teeth and on the inside (tongue side) surfaces of teeth that either could not be reached by conventional straight brushes or would be highly demanding of the operator to adjust the straight brush to reach these surfaces. Despite this improvement over straight designs, the rigid fixture of the head to the handle could not adapt to various angles of access and presented an abnormal relationship of brush head to teeth when a straight brush design might serve best.

Some of these angled designs also suffered from design imbalance. A balanced toothbrush is designed so that the brush head meets a line that extends from the longitudinal axis of the handle. The farther the brush head is from this axis line, the more out of balance the brush is. The greater the brush imbalance, the greater amount of force must be applied to the handle to activate the bristles on the brush head.

One variation included a flexible connector between the brush head and brush handle with a spring-like connector designed to absorb excess forces applied to the brush to prevent tooth abrasion, but it yielded control while relieving stress. In addition, there was little or no true rotation of the brush head itself to offer improved access for improved hygiene.

All known toothbrushes have bristles covering the entire brushing surfaces, and the common use of toothpaste requires the operator to either precariously place toothpaste on the surface of the bristles or force the toothpaste in between the bristles. These techniques of toothpaste placement risk toothpaste being dislodged from the bristles or becoming imbedded inbetween the bristles and not being effective or evenly used during the brushing period.

SUMMARY OF THE INVENTION

The improved toothbrush of this invention provides a modified toothbrush structure to efficiently accommodate cleaning sites in the mouth. The inventive toothbrush comprises a handle with an elongate grip and a support section extending from the grip to the brush head with an arch shape. The arch diverges outwardly of the longitudinal axis of the grip to an apex at a point of maximum divergence and has a leg that is distal to the grip and that returns toward the longitudinal axis of the grip to the axis of rotation of a pivot connection with the brush head which is a substantial distance toward the longitudinal axis of the grip from the apex of the arch and desirably closer to the longitudinal axis of the grip than to the apex of the arch. The brush head has a longitudinal axis and terminates along that axis in a heel in the direction of the grip of handle and in a toe in the direction away from the grip. The top of the brush head is proximal to the pivot connection with the distal leg of the support and the bottom, which is distal to the pivot connection, has bristles depending therefrom and distributed therealong from the heel to the toe.

The pivot of the pivot connection has an axis of rotation generally normal to the longitudinal axis of the grasp and to the longitudinal axis of the brush head for relative pivotal movement therebetween within a range of movement extending over a predetermined acute angle arc from a position where the longitudinal axis of the brush is parallel with the longitudinal axis of the grasp to move the heel of brush head toward the distal leg of the support over the predetermined acute angle arc.

The inventive toothbrush provides a pivotable brush head where the axis of the rotation of the brush head is perpendicular to both the longitudinal axis of the handle and to the brush bristles. This rotational axis is roughly parallel to long axis of the teeth targeted for cleaning and can align itself to match the surfaces of the teeth as it follows the arch or curvature of the dentition.

The inventive brush is strong yet narrow in dimension to be relatively equivalent to the width of other toothbrushes. The secured, fixed attachment of the head of the brush to the handle precludes the risk of inadvertent release of the brush head.

The inventive brush was designed around the principles of oral hygiene and safety. There are only two moving parts and the juncture of these parts is enclosed and protected. The bulk of the connector from the handle is preserved providing strength, and the connection of parts which encases the connector from the handle are permanently bonded. The exterior design of the brush head not only protects the connector joint in plastic, but protects the user from irritation from moving parts through the smooth shape of surrounding plastic. Surfaces between moving parts are kept as flush as possible and in positions that would be least likely to engage tissue. The design blends its utility with the simple and attractive appearance of the brush head.

The design of the brush is sensitive to the broad range of abuse that toothbrushes commonly receive. It can be used by unskilled people with little risk of breakage or damage. The nearly full coverage of the connector on the brush adds security to linkage of the brush head to the handle.

The handle of the inventive brush has two obtuse angles (described as arch-shaped) which allows the brush to reach around obstacles such as front teeth and be able to reach back teeth including the distal (back surface area) of posterior teeth. This bi-angled design also allows for freedom of rotation of the brush head without interference from the handle.

The rigid connector support from the grasp of brush handle of the brush attaches to the brush head within a confined and protected space without consuming the entire width of the brush head. This allows for adapting many different sizes and shapes of brush heads while maintaining the protective strength of the connector.

The position of the rotation on the brush head is near the midline of the brush but slightly anterior to the midline of the brush head. This will assure adequate cleaning pressure at the tip of the brush and assures the tip of the brush will follow the contours of the teeth far into back parts of the mouth.

The inventive brush could accommodate a variety of brush head profiles. One preferred brush head design is triangular with a compact size and rounded edges to permit access with safety to reach confined areas within the mouth.

No special connecting pins, coiled springs, or metal is required in the brush to connect the head to the handle. This characteristic simplifies production and reduces costs of fabrication.

The inventive brush may include a strong, protected, yet flexible small plastic tongue extending from the handle from the brush handle to the brush head inside the connector assembly. The spring-like projection of plastic helps maintain a static position of the brush head until the head is activated as it is pressed against the teeth. This plastic spring then acts as a "shock-absorber" to let the brush follow the contours of the teeth with less rocking or instability. In its static position, the spring stabilizes the brush as materials such as toothpaste are applied to the brush head.

The small plastic extension of the handle which serves as a spring device to maintain a stable position of the brush head can be varied to a firm state to resist rotation or to a loose state allowing more free rotation of the toothbrush head. Likewise, the spring device may be deleted altogether for totally free rotation of the brush head. The looseness of the brush head has some advantage since it can freely move against the teeth and conform better to tooth surfaces.

The inventive brush maintains a quality of "balance" not explicit in prior art toothbrushes. Balance is defined as the longitudinal axis from the handle intersecting the point of rotation of the brush head. The benefit is that the shorter the radius between the point of rotation and this axis will minimize the amount of applied stress needed to activate and brush and increase the comfort for the user since any torquing or twisting effect of having the rotation point off this line will be minimized. The longer the radius, the more twisting action of the brush handle will be necessary to activate it or control it.

The inventive brush defines a limit to maximum rotation of 25–35 degrees. In a similar vein, the starting point of rotation is fixed when the flat surface of the brush head (perpendicular to the bristles) is parallel to the flat portion of the brush handle. The rotation occurs as an action of the tip of the brush descending as the heel of the brush head rotates up toward the brush handle. This limitation of rotation is intended to increase the control of the user while allowing for sufficient rotation action to adjust to variations of tooth surfaces. The range of rotation is designed to be aesthetic and not too radical to increase its acceptance by current users of conventional brushes.

The freely rotating brush head rotates with each stroke and the toe and heel of the brush head has a tendency to "dive" in between teeth. This seems to accentuate its cleaning activity. Equally significant, this action clearly discourages a broad "scrubbing" technique by users which is known to be a primary cause of toothbrush abrasion and associated maladies including gingival (gum) recession, tooth abrasion and formation of grooves on teeth, root sensitivity, etc.

An optional feature might include additional thickness of plastic on the lower part of the brush head to accommodate placement of bristles adjacent to the depression or recess in the brush head into which the ball of the handle fits.

DETAILED DESCRIPTION OF A PREFERRED EMBODIMENT

Figure 1:
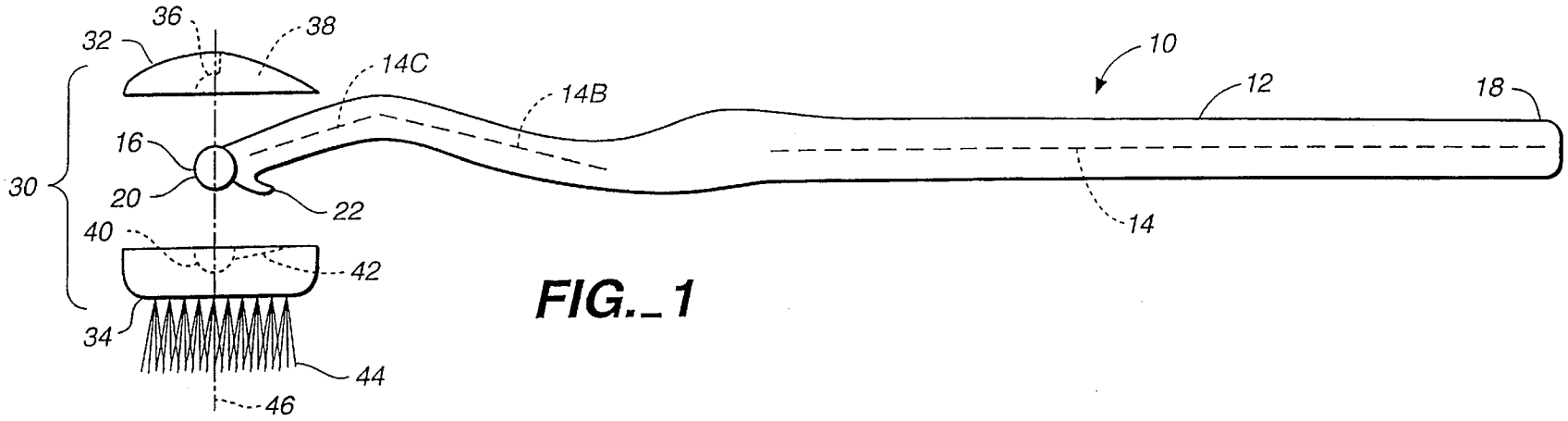
FIG. 1 is an exploded side elevation view of an improved toothbrush of this invention illustrating the component parts.

In FIG. 1, which illustrates a first embodiment of this invention, toothbrush 10 comprises handle 12 having an elongate section or grip having a longitudinal axis 14, which for gripping by the user. Extending generally outward of the grip in the general direction of axis 14 is a support section of handle 12 having a generally arch-shaped portion. The arch-shaped portion has a leg proximal to the grip that extends outwardly of axis 14 at an acute angle, along its longitudinal axis 14*a* to an apex at a point of maximum divergence from axis 14, and a leg distal to the grip that extends back toward axis 14, along its longitudinal axis 14*b* at an acute angle with the axis 14, to end 16 of handle 12 at a connection with a brush head 30 which includes pivot element 20. Pivot element 20 has a pivot axis 48. As can be seen from FIGS. 1 and 2, pivot axis 48 is closer to axis 14 than to the apex of the arch and and, as shown, preferably lies essentially along axis 14, Pivot element 20 connects the distal leg of the arch-shaped portion of the handle support to the top of brush head 30 at handle end 16 and its axis of rotation lies along axis 14.

Brush head 30 has a top that is proximal to the connection with distal leg of the handle and a bottom that is distal to this connection. Brush head 30 has a longitudinal axis that extends generally, in one direction, toward the handle grip, and in the other direction, away from the grip, terminating at a heel in the direction of the grip and at a toe in the direction away from the grip. Bristles 44 depend from the bottom of brush head 30 generally in a direction normal thereto, as shown at 46, and are distributed therealong front the toe to the heel.

Figure 2:
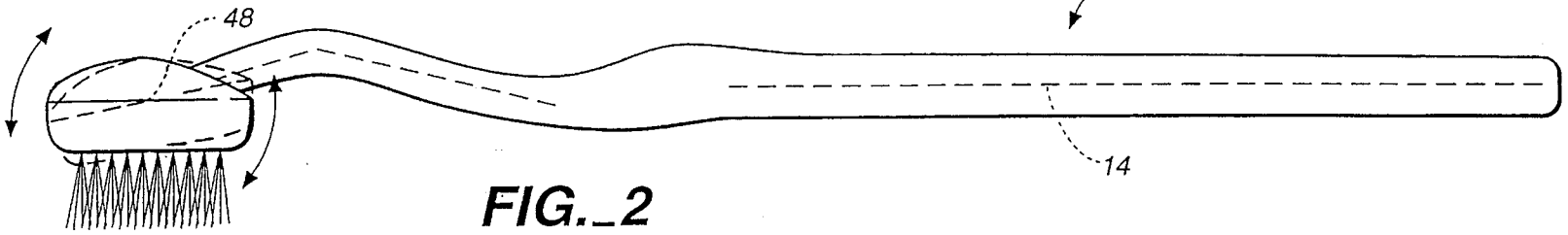
FIG. 2 is a side elevational view of the improved toothbrush of this invention as assembled.
Figure 3:
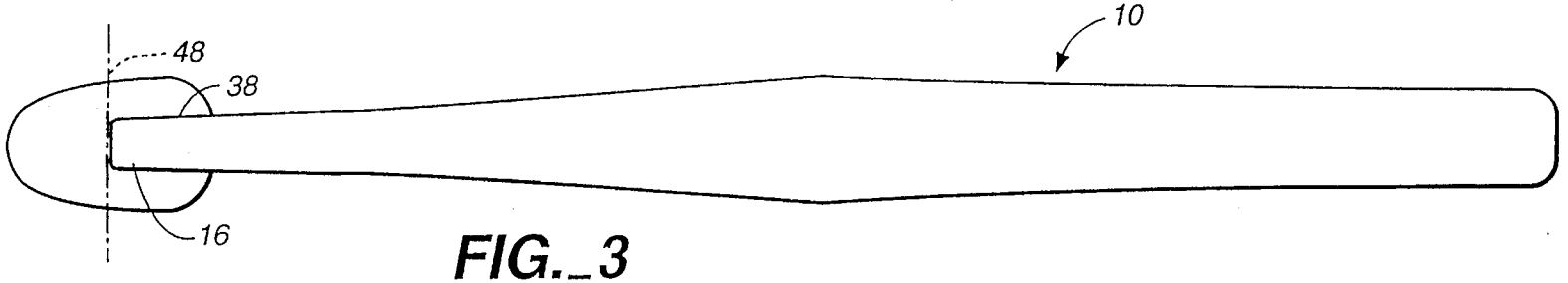
FIG. 3 is a top plan view of the improved toothbrush of this invention illustrating the position of the distal leg of the handle received in the brush head. guide slot.

Brush head 30 has a main body 34 with a cover section 32, shown in FIG. 1 in a disengaged or disassembled position and in FIG. 2 in the engaged position overlying main body 34 to form a portion of the top of brush head 30. Main body 34 has a bearing 40 forming a recess in the upper side thereof for receiving pivot element 20. Cover section 32 has a bearing 36 that cooperates with bearing 40 to retain pivot element 20 for rotation of brush head 30 about pivot axis 42 which is normal to the plane of the drawing of FIG. 1 and normal to axis 14 of the handle grip. Pivot axis 42 is also normal to the longitudinal axis of brush head 30. As best seen in FIGS. 1 and 3, pivot axis 42 is also generally normal to the longitudinal axis 14C of the distal leg of the handle. As best seen by reference to FIGS. 1, 2 and 6, pivot axis 42 is positioned anterior to the mid-position or midline between the heel and toe of the brush head, but closer to the midline than it is to toe of the brush head.

Figure 4:
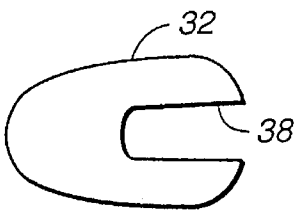
FIG. 4 is a top plan view of the brush head member cover section of the embodiment of FIG. 1 illustrating the guide slot.

As seen in FIGS. 3 and 4, cover section 32 has a handle guide slot 38 which extends longitudinally from a medial position toward the heel of the brush head to provide clearance for cover section 32 to be secured in an engaged position on main body 34 over pivot element 20 received in the recess provided by the pivot element bearing 40 and to engage with the distal leg of handle 12, as discussed below. Main body 34 has a slot 42 which extends from the recess of bearing 40 to the heel of the brush head. Slot 42 underlies slot 38 of cover section 32 and with slot 38 also engages with the distal leg of handle 12.

Also as seen in FIG. 1, an integral spring element 22 is provide on the distal leg of handle 12 in the rotational path of brush head 30 to bias it toward the position at which the longitudinal axis of the brush head is parallel with the longitudinal axis of the grip of handle 12. The embodiment shown by this view illustrates that the entire toothbrush may consist of only three parts, thereby reducing manufacturing costs.

FIG. 2 is a side elevational view of the improved toothbrush 10 of this invention as assembled. This view illustrates the general alignment of the brush head pivot axis 48 with the primary longitudinal axis 14 of the handle. As seen in FIG. 3, distal leg of the handle at end 16 is received in slots 38 and 42 of the brush head. Guide slots 38 and 42 permit tangential movement of the distal leg about the pivot axis 48 relative to brush head 30 and provide a brace against turning forces in other directions to thus eliminate any other relative movement. Also, as best seen in FIGS. 1 and 3, the margin of slot 34, at the cover section bearing 36 abuts the terminal portion of the distal leg of the handle when the brush head longitudinal axis is parallel with the longitudinal axis of the handle grip and thus serves to stop further pivotal movement of the brush head in the direction to move the heel further downward and away from the distal leg.

FIG. 4 is a top plan view of the brush head member cover section 32 illustrating the guide slot 38. This view illustrates the relatively simple shape of the brush head member. This shape can of course be modified to accommodate specific dental applications.

Figure 5:
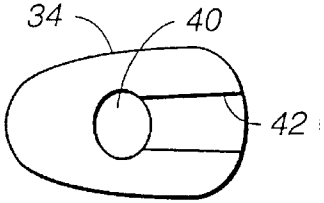
FIG. 5 is a top plan view of the brush head of the embodiment of FIG. 1, with the cover section thereof removed illustrating the pivot element bearing and guide slot.

FIG. 5 is a top plan view of the brush head member bottom portion 34 illustrating the pivot element bearing 40 and guide slot 42. The bearing 40 (and the respective bearing 36 on the brush head cover section 32) provides a socket-type capture of the "ball" or pivot element 20 of the brush handle distal leg. Other pivotable arrangements could be utilized, such as a cylindrical axle, removable pin, or the like.

Figure 6:
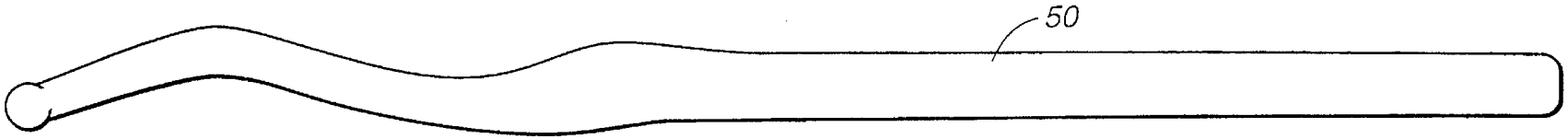
FIG. 6 is a side elevation view of an alternate embodiment of a handle without an integral spring element.

FIG. 6 is a side elevation view of an alternate embodiment of a handle member 50 without an integral spring element. This design is simpler, and may even be preferable in certain applications, as described supra.

Figure 7:
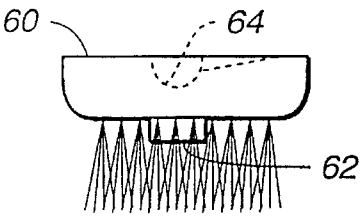
FIG. 7 is a side elevation view of an alternate embodiment of a brush head a with the cover section thereof removed, illustrating reinforcement feature to accommodate placement of bristles adjacent the depression in the brush head (i.e., pivot element bearing.

FIG. 7 is a side elevation view of an alternate embodiment of a brush head main body 60 bearing a reinforcement feature 62 to accommodate placement of bristles adjacent the depression or recess in the main body (i.e., pivot element bearing 64). This reinforcement feature enables secure fastening of a full array of downwardly-depending bristles, which may be desirable.

Several objects and advantages of the inventive apparatus include:

a. A rotational head.

b. A rotational axis which is perpendicular to the brush handle axis. This maximizes control while allowing the brush head to fit the surface against which it rests while the operator can still move and adjust the brush head position by rotating the brush or bodily movement of the brush handle.

c. While allowing rotation to accommodate brush head position, there are built-in limits to rotation which prevent a brush head position which would be impractical or ineffective.

d. The position of the socket on the brush head which accepts the rotator ball of the brush handle is small enough to not interfere with a variety of bristle lengths and still be easily fit into a mouth with a small aperture. Even a children's design is fully possible.

e. The position of the socket on the brush head is positioned just distally (toward the end farthest from the brush handle) of the mid-position between the heel and toe to permit the distal tip of the brush head to guide the rotation of the brush head while still applying relatively balanced forces on the brush bristle area.

f. The arrowhead brush head design is intended to fit the bristles of the narrow distal end of the brush head into small areas in the back of the mouth, yet broad at its medial end to cover a wide surface area of the teeth and gums.

g. The small brush head is designed to improve accessibility to all parts of the mouth-regardless of the size of mouth.

h. The current design has higher bristles on the periphery of the brush head with shorter bristles in the center area. This allows for extension of bristle laterally toward the gingiva (gums) of the target area and distally toward back teeth and interproximal dental spaces (between teeth) while leaving the center bristles to be activated on the tooth surfaces.

i. The small area on the brushing surface that does not have bristles is intended to be used as a toothpaste "well" where toothpaste can be placed without concern of falling off the brush. This storage area stabilizes the toothpaste without having to force paste in between the bristles which can cause "caking" of the paste.

j. The brush is a balanced design where a line extending from the axis of the brush handle grip meets the ball and socket joint between the handle and the brush head.

k. The arched handle design allows the brush to "bend" around obstructions or gain access to tooth surfaces in the back of the mouth while maintaining the advantages of the balanced design.

l. The rotational head can accept most of the contemporary bristle types and bristle designs.

m. The brush head has a groove slot that accepts the distal end of the handle to permit a wider range of rotation without obstruction from the brush head.

n. The broad handle contributes to brush stability.

o. A long handle can be manipulated by large or small hands.

p. The narrow neck of the brush handle is consistent with size of the brush head, yet is broad enough to sustain the stresses of abuse.

q. The top (non-bristle) side of the brush head is contoured to contribute to the compact head design and is tapered at all edges to permit smooth movement without any interference to brush movement and improve the fit of the brush head into tight spaces.

r. The hinge or pivot is generally closed; covered by the back of the brush head. This will prevent any pinching or snagging of oral tissues. The contours of the back of the brush head are designed to enhance this protective characteristic.

s. The three-part design is structured to be the simplest for manufacture with only a single easily articulated binding surface between the brush head and its back.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. An articulate toothbrush comprising a handle, a brush with a separate cover section and a pivot connection between the brush and the handle and wherein:

a. the handle comprises an elongate grasp, for grasping about the longitudinal axis thereof, and a brush support connected to one end of the grasp and extending away from the grasp generally in the direction of the longitudinal axis of the grasp, the brush support having a generally arch-shaped portion diverging from the longitudinal axis thereof to an apex at a point of a maximum divergence therefrom and having a leg distal to the grasp that extends back toward the longitudinal axis of the grip to the axis of rotation of a pivot connection with a brush, the axis of rotation being located a substantial distance toward the longitudinal axis of the grip from the apex of the arch-shaped portion of the handle.

b. the brush comprises a head having a longitudinal axis that extends, in one direction, toward the grip, the head terminating in that direction at a heel, and, in the other direction, away from the grip, the head terminating in that direction at a toe, and having a top proximal to the connection and a bottom distal to the connection, the bottom having bristles depending therefrom and generally distributed therealong from the toe to the heel of the head and c. the pivot connection comprises a pivot located along the longitudinal axis of the brush head at a medial position between the heel and toe and having an axis of rotation generally transverse to the longitudinal axis of the grasp and to the longitudinal axis of the brush head for relative pivotal movement therebetween within a range of movement extending over a predetermined acute angle arc from a position where the longitudinal axis of the brush is parallel with the longitudinal axis of the grasp to move the heel of brush head toward the distal leg of the support over the predetermined acute angle arc, d. the pivot connection further comprises a pivot element located on the distal leg of the support, a recess in the top of the brush head centrally located in the direction across the head transverse to its longitudinal axis and a bearing in the brush head at the recess to receive and retain the pivot element for relative rotational movement about its pivot axis and e. the brush head includes a separate cover section that forms at least a part of the top thereof and is secured thereto, the cover section having a bearing overlying the recess to retain the pivot element for rotation about its pivot axis, and the brush head has a slot in the top thereof extending, in the direction toward the bottom of the brush head, partially through the brush head and, in the longitudinal direction of the brush head, from the recess toward the heel, the slot being sized to receive the distal leg of the support as the heel of the brush head rotates in the direction of the distal leg, whereby the slot supports the pivotal connection against turning forces in directions other than about the pivot axis, shields the margins between the distal leg and top of the brush head from entry and pinching of mouth tissue and stops rotation of the heel of brush head in the direction of the distal leg.

2. A toothbrush as in claim and wherein the slot forms at least a part of the slot extending from the recess toward the heel of the brush head for receiving the distal leg.

* * * * *